United States Patent [19]

Nakata et al.

[11] Patent Number: 4,712,706

[45] Date of Patent: Dec. 15, 1987

[54] EASY OPEN TYPE CAN

[75] Inventors: Akira Nakata, Ageo; Shiroh Matsumoto; Hitoshi Tozima, both of Kasukabe; Masahiko Minato, Iwatsuki, all of Japan

[73] Assignee: Hokkai Can Co., Ltd., Tokyo, Japan

[21] Appl. No.: 4,645

[22] Filed: Jan. 20, 1987

[51] Int. Cl.[4] ..... B65D 41/32

[52] U.S. Cl. ..... 220/276; 220/270

[58] Field of Search ..... 220/270, 276, 359; 215/256; 229/43 R

[56] References Cited

U.S. PATENT DOCUMENTS

| | | | |
|---|---|---|---|
| 4,212,409 | 7/1980 | Jeppson | 220/276 |
| 4,503,990 | 3/1985 | Roth et al. | 220/276 |
| 4,533,063 | 8/1985 | Buchner et al. | 220/270 |

*Primary Examiner*—George T. Hall

*Attorney, Agent, or Firm*—Birch, Stewart, Kolasch & Birch

[57] ABSTRACT

An easy open type can including a can closure having a top panel with a peripheral wall portion extending downwards from a circumferential edge of the top panel portion thereof. A tab is provided for opening the closure. A score line is constructed in the peripheral wall portion so as to be connected to an end of one side edge of the tab and extending over the whole circumference of the peripheral wall portion. The peripheral wall portion is mounted on and fixed to an open end portion of a can barrel. The can closure is formed of a metallic foil and a thermoplastic resin layer covering an outer surface of the metallic foil and the score line is constructed by removing only the resin layer of the peripheral wall portion of the can closure. The score line is provided in a region of the peripheral wall portion that is adhered to the open end portion of the can barrel.

4 Claims, 9 Drawing Figures

EASY OPEN TYPE CAN

BACKGROUND OF THE INVENTION

1. Field of the Invention

This invention relates to an easy open type can which can be opened by breaking a score line.

2. Description of Background Art

A can has been hithertofore known, as shown in FIG. 7, wherein an open portion of a can barrel a is hermetically closed by mounting a metallic can closure g on an open end portion b of the can barrel a. A score line e is provided along the whole circumference of an upper edge of a peripheral wall portion d thereof extending downwards from the whole circumferential edge of a top panel portion c. A tab f for breaking the score line e is provided on a lower edge of the peripheral wall portion d so as to be connected thereto.

However, this construction requires the score line formed in the metallic can closure g for hermetically closing the open portion h of the can barrel a to be made therein so as to have a predetermined constant depth for every metallic can closure. Accordingly, quality control is very difficult in making the cans. Additionally, for preventing the can closure from being broken at the socre line by vibrations or a shock given during transportation thereof, it is necessary to use a can closure which is comparatively large in thickness. Increasing the thickness increases the weight of the can, and increases the cost in producing the can. Further, a difficulty arises in incineration of the can after use.

In addition, an easy open type can is known wherein an open portion h' of a can barrel thereof is hermetically closed by a plastic closure with a score line made in a center region of a top panel portion thereof. A tab for breaking the score line is provided on an upper surface of the top panel portion. This can construction is disclosed in Japanese Patent Application Kokai No. Sho 59-199462. In more detail, the above type of easy open type can is shown in FIGS. 8 and 9. Namely, a can closure o' for hermetically closing an open end portion b' of a can barrel a' is made of a plastic panel composed of a heat sealable resin inner layer member d' and a gas impermeable resin layer e'. A score line f' for defining a region of the plastic panel that is to be opened toward the center of the plastic panel is constructed in the can closure c' so as to reach only the layer e' of the plastic panel. A tab g' for breaking open the can closure c' at this region is provided in the region of the plastic panel so as to be combined therewith in such a manner as shown in FIGS. 8 and 9.

However, with this construction, if the can closure c' is pushed from above or a force is applied with an internal pressure which is increased by the carbonated type of contents of the can, or the can is subjected to a shock during transportation of the can, may result in that the plastic panel constituting the can closure c' may be deformed. In addition, the closure may be torn open as a result of distortion made at the thin portion containing the score line f'. Accordingly, it is required to increase the thickness of the inner layer member d' of the plastic panel.

SUMMARY AND OBJECTS OF THE INVENTION

This invention has for its object to solve the foregoing problems with the foregoing conventional easy open type cans. An easy open type can is provided in which a score line is not made directly in a metallic foil of the can closure used for hermetically closing an open end portion of a can barrel. Thus, the can closure may have a reliable opening property. A region of the can closure in which the score line is made is not broken open even when the internal pressure or the external pressure is applied to the can closure.

A purpose of this invention is to solve the foregoing problems. Namely, according to this invention, an easy open type can is provided wherein a can closure is mounted on a lower edge of a peripheral wall portion extending downwards from the whole circumferential edge of a panel portion thereof. A tab for opening the closure is additionally provided with a score line connected to an end of one side edge of the tab and extending over the whole circumference of the peripheral wall portion thereof. The peripheral wall portion is mounted on and fixed to an open end portion of a can barrel. The can closure is formed of a metallic foil and a thermoplastic resin layer covering an outer surface of the metallic foil. The score line is made by removing only the resin layer of the peripheral wall portion of the can closure. The score line is provided in such a region of the peripheral wall portion that is adhered to the opening end portion of the can barrel.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBDODIMENT

Figure 1:
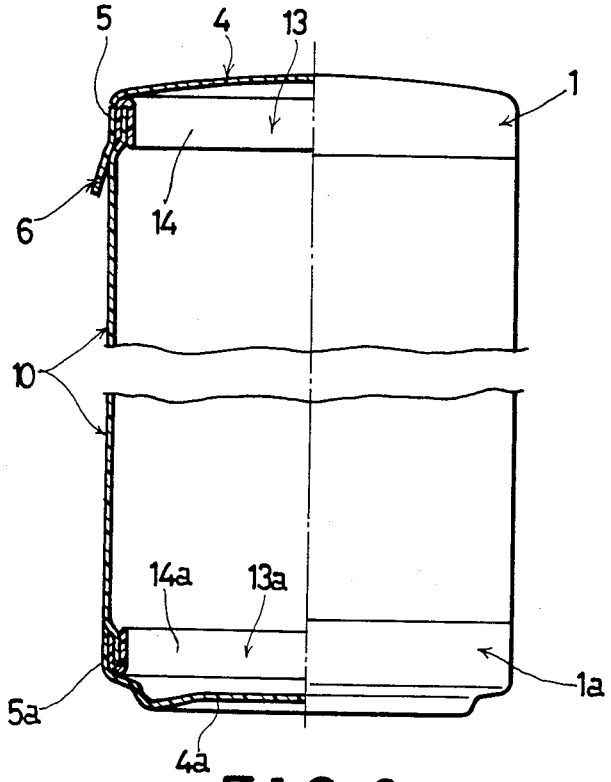
FIG. 1 is a side view, partly in section, of one embodying example of the present invention.
Figure 2:
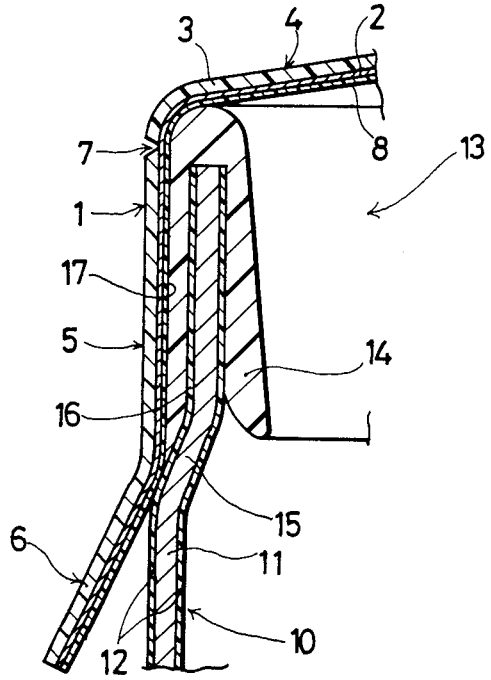
FIG. 2 is an enlarged view of an important portion thereof.
Figure 3:
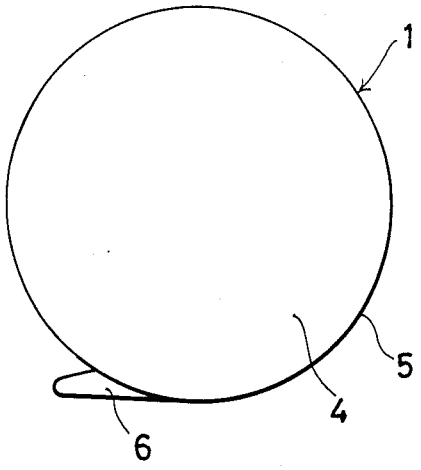
FIG. 3 is a top plan view of a can closure thereof.
Figure 4:
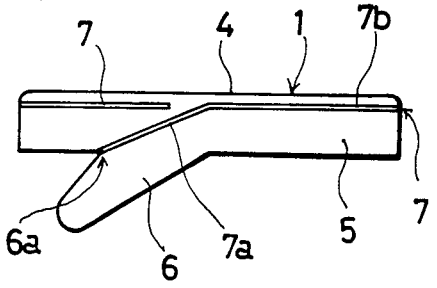
FIG. 4 is a side view of the can closure.
Figure 5:
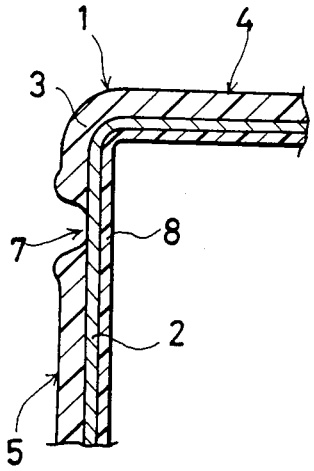
FIG. 5 is an enlarged view of an important portion thereof.

Referring to FIGS. 1–5 showing one example thereof, a can closure 1 is formed of a metallic foil 2 such as tin-free steel, aluminum or the like, and a thermoplastic resin layer 3 such as of polypropylene, polyethylene or the like which covers an outer surface of the metallic foil 2. The whole circumferential edge of a top panel portion 4 of the can closure 1 having a peripheral wall portion 5 in cylindrical form extending downwards therefrom, and a tab 6 for opening is connected to a lower edge of the peripheral wall portion 5 so as to protrude downwards therefrom.

The peripheral wall portion 5 of the can closure 1 is provided with an oblique score line 7*a* extending obliquely upwards from an upper end of one side edge 6*a* of the tab 6 and a horizontal score line 7*b* connected to an upper end of the oblique score line 7*a* and extending horizontally the circumference of the peripheral wall portion 5 at a level below an upper or shoulder edge of the peripheral wall portion 5. The two score lines 7*a*, 7*b* constitute a score line 7 formed by removing the resin layer 3 by thrusting a heated cutter, for instance, into only the foregoing thermoplastic resin layer 3 covering the outer surface of the metallic foil 2 as clearly shown in FIG. 5.

As shown in the illustrated example, the score line 7 is deep so as to reach the full depth of the thickness of the resin layer 3 but may be shallow so as to reach only half way of the full thickness of the resin layer 3.

A covering or coating film 8 of resin having a heat adhesion property such as a polyolefin series, a polyamide series, a polyester series or the like, for instance, is applied to an inner surface of the can closure 1.

A can barrel 10 has an open portion 13 surrounded by an open end portion 15, and is composed of a cylindrical barrel portion 11 made chiefly of paper and coating films 12, 12 of a heat adhesion property applied on inner and outer surfaces of the barrel portion 11.

In the illustrated example, the open end portion 15 of the can barrel 10 is provided with a neck-in portion so as to be made smaller in diameter than the middle barrel portion 11 of the can barrel 10. A reinforcement member 14 is included which is in cylindrical form and in a nearly U-shape in section and made of resin having a heat adhesion property. The reinforcement member 14 is mounted on and adhered to the open end portion 15. An inner peripheral surface 17 of the peripheral wall portion 5 of the can closure 1 is mounted on an outer peripheral surface 16 of the open end portion 15 of the can barrel 10. The mutually mounted portions 5, 15 are adhered and fixed together through the coating film 8 and the reinforcement member 14. In short, the peripheral wall portion 5 of the can closure 1 is mounted on and adhered to the open end portion 15 of the can barrel 10 through the covering film 8 and the reinforcement member 14 interposed therebetween.

Another open portion 13*a* surrounded by a lower opening end portion of the can barrel 10 is hermetically closed by a bottom can closure 1*a*. In more detail, the bottom can closure 1*a* is formed by a top panel portion 4*a* and a peripheral wall portion 5*a* extending upwards from the whole circumferential edge of the panel portion 4*a*. The panel portion 4*a* is formed of a metallic foil having inner and outer surfaces which are applied with respective covering films having a heat adhesion property. The panel portion 4*a* is mounted, at the peripheral wall portion 5*a*, on the open end portion of the can barrel 10 through a reinforcement member 14*a* mounted on the open end portion and is adhered and fixed thereto.

As described above, according to the can of this invention, the score line 7 to be formed in the peripheral wall portion 5 of the can closure 1 can be made by removing the resin layer 3 in such a manner that a heated cutter is brought to cut only in the resin layer 3 of the peripheral wall portion 5 of the can closure 1. Thus, the metallic foil 2 is not injured so that the can closure 1 can maintain its strength. Therefore, if the resin layer 3 is increased in thickness, the strength of the can closure 1 can be maintained strong even if the metallic foil 2 is decreased in thickness, so that the can closure 1 can be decreased in weight. Further, the inner surface 17 of the peripheral wall portion 5 having the score line 7 is adhered and fixed to the outer surface 16 of the open end portion 15 of the can barrel 10. Thus, even if the metallic foil 2 of the can closure 1 is decreased in thickness, such a region of the metallic foil 2 that faces the score line 7 region of the can closure 1 is not broken even when an internal pressure or an external pressure is applied thereto.

Furthermore, the score line 7 is arranged to be made by removing only the resin layer 3 especially by applying a heated cutter, for instance, to only the resin layer 3 as far as the full depth thereof, so that the score line 7 can be automatically made into one of a predetermined depth.

Accordingly, by pulling the tab 6 upwards, the metallic foil 2 is broken along on the score line 7, so that a reliable opening of the can can be ensured.

In the illustrated example, the can barrel 10 is made of paper, but a metallic thin sheet material may be used for making the can barrel 10. In the case of a composite can of which the can barrel is made of paper, not only the can barrel 10, but also the can closure 1 can be incinerated so that there is no diposal problem.

Figure 6:
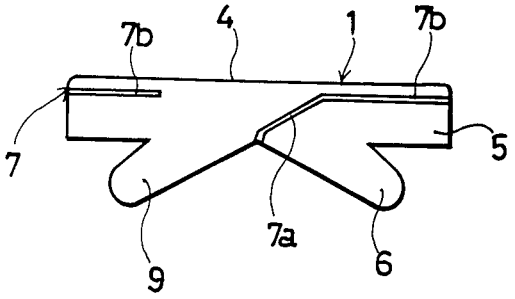
FIG. 6 is a side view of a modified can closure.
Figure 7:
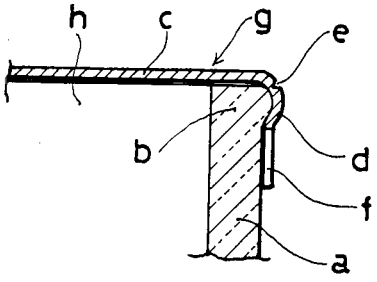
FIG. 7 is a sectional side view of a portion of a conventional example.
Figure 8:
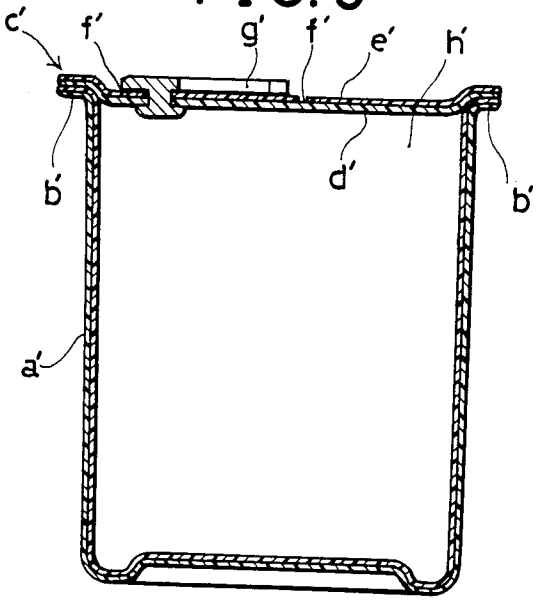
FIG. 8 is a sectional side view of another conventional example.
Figure 9:
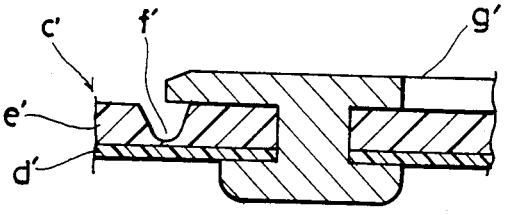
FIG. 9 is an enlarged view of a portion thereof.

FIG. 6 shows a modified example of the can closure 1 used in the can according to this invention. In this example, a subsidiary tab 9 for opening is provided on a lower edge of the peripheral wall portion 5 so as to protrude downwards therefrom and be located adjacent to the foregoing tab 6 provided on the lower edge of the peripheral wall portion 5.

Thus, according to this invention, the can closure is composed of the metallic foil and the thermoplastic resin layer covering the outer surface of the metallic foil. The score line is formed by removing only the resin layer of the peripheral wall portion. Also, the score line is made in such a region of the peripheral wall portion of the closure that is fixed to the can barrel so that the metallic foil of the peripheral wall portion having the score line is never broken even when the can closure is applied with an internal pressure or an external pressure. Further, the score line is formed only in the resin layer of the peripheral wall portion so that the metallic foil which is not provided with the score line can be decreased in thickness. As a result, the whole weight of the can can be decreased. Furthermore, the score line is formed by removing only the resin layer, so that the same can be made easily and reliably so as to have a predetermined depth. Thus, there can be obtained an easy open type can which has a stable and reliable opening property.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An easy open type can comprising:

a can closure including a top panel having a peripheral wall portion extending downwards from a circumferential edge of the top panel portion thereof;

a tab for opening the closure;

a score line constructed in the peripheral wall portion so as to be connected to an end of one side edge of the tab and extending over the whole circumference of the peripheral wall portion;

said peripheral wall portion is mounted on and fixed to an open end portion of a can barrel;

said can closure is formed of a metallic foil and a thermoplastic resin layer covering an outer surface of the metallic foil and the score line is constructed by removing only the resin layer of the peripheral wall portion of the can closure, and the score line is provided in such a region of the peripheral wall portion that is adhered to the open end portion of the can barrel.

2. An easy open type can according to claim 1, wherein the peripheral wall portion of the can closure is provided on its inner surface with a covering film of resin having a heat adhesion property, the open end portion of the can barrel is provided thereon with a reinforcement member of resin having a heat adhesion property, and the peripheral wall portion and the open end portion are adhered together through the covering film and the reinforcement member by fushion adhesion thereof.

3. An easy open type can according to claim 1, wherein a beginning of said score line and an end of said score line are spaced a predetermined distance apart on a width portion of said tab.

4. An easy open type can according to claim 1, wherein said top panel of said can closure is uniform and said score line is formed only on said peripheral wall portion of said closure.

* * * * *